US008020716B2

(12) United States Patent
Vitale

(10) Patent No.: US 8,020,716 B2
(45) Date of Patent: Sep. 20, 2011

(54) APPARATUS FOR ORGANIZING AND STORING SPORTS EQUIPMENT

(75) Inventor: Lisa Vitale, Huntington, NY (US)

(73) Assignee: 4 Smart People, Inc., Huntington, NY (US)

( * ) Notice: Subject to any disclaimer, the term of this patent is extended or adjusted under 35 U.S.C. 154(b) by 399 days.

(21) Appl. No.: 12/014,877

(22) Filed: Jan. 16, 2008

(65) Prior Publication Data

US 2008/0169253 A1 Jul. 17, 2008

Related U.S. Application Data

(60) Provisional application No. 60/880,561, filed on Jan. 16, 2007.

(51) Int. Cl.
*A47B 47/00* (2006.01)

(52) U.S. Cl. ..... 211/197; 211/205

(58) Field of Classification Search ..... 211/197, 211/196, 205, 182, 105.3, 105.13, 133.4, 211/166, 172, 85.24, 115, 107–112, 175; 248/158

See application file for complete search history.

(56) References Cited

U.S. PATENT DOCUMENTS

| | | | | | |
|---|---|---|---|---|---|
| 445,633 | A | | 2/1891 | Becker | |
| 670,144 | A | * | 3/1901 | Bond | 248/125.3 |
| 896,990 | A | * | 8/1908 | Hill | 248/125.3 |
| 1,038,198 | A | * | 9/1912 | Randall et al. | 211/205 |
| 1,089,290 | A | * | 3/1914 | Thompson | 248/165 |
| 1,175,817 | A | * | 3/1916 | Robertson | 211/170 |
| 1,266,749 | A | * | 5/1918 | Abbott | 211/205 |
| 1,292,314 | A | * | 1/1919 | Hays | 211/163 |
| 2,639,930 | A | * | 5/1953 | Thornton | 403/144 |
| 3,204,779 | A | * | 9/1965 | Warner | 211/190 |
| 3,310,180 | A | * | 3/1967 | Neagle | 211/205 |
| 3,638,814 | A | * | 2/1972 | Lowery | 211/189 |
| 4,750,627 | A | * | 6/1988 | Myers | 211/205 |
| 4,767,088 | A | * | 8/1988 | Fielder et al. | 248/121 |
| 4,792,071 | A | | 12/1988 | Scarpa et al. | |
| 4,919,368 | A | * | 4/1990 | Garrett | 248/121 |
| D326,573 | S | * | 6/1992 | Crawford et al. | D6/458 |
| 5,377,849 | A | * | 1/1995 | Martin | 211/85.7 |
| D355,288 | S | | 2/1995 | Mallen | |
| 5,617,958 | A | | 4/1997 | Laug et al. | |

(Continued)

OTHER PUBLICATIONS

Example drying rack 1, http://www.hockey1.com/, unknown manufacturer, unknown manufacture date. Photo attached. Publication date at least as early as Mar. 22, 2006.

(Continued)

*Primary Examiner* — Jennifer E. Novosad

(74) *Attorney, Agent, or Firm* — Hahn Loeser & Parks, LLP; John J. Cunniff

(57) ABSTRACT

A rack for drying, storing or organizing sports equipment includes a central post having a vertical axis, a plurality of holes substantially perpendicular to the vertical axis, and a plurality of tier members adapted to be inserted into one or more of the holes. The tier members include first and second members. The second members are adapted to be inserted into an end of and secured at any of a plurality of positions within, the first member. The rack may also have one or more holes that extend through the vertical post, the first member may be inserted through the holes, and a third member may be adapted to be inserted into an end of and secured at any of a plurality of positions within, the first member.

20 Claims, 10 Drawing Sheets

U.S. PATENT DOCUMENTS

| | | | | | |
|---|---|---|---|---|---|
| 5,678,698 | A | * | 10/1997 | Cabral | 211/33 |
| D391,706 | S | * | 3/1998 | Malcolm | D32/35 |
| D398,469 | S | | 9/1998 | Leong et al. | |
| 5,848,716 | A | | 12/1998 | Waranius | |
| 5,855,286 | A | | 1/1999 | Zaid et al. | |
| 5,862,924 | A | * | 1/1999 | Dumont | 211/85.7 |
| 5,906,277 | A | | 5/1999 | Vienneau | |
| 6,138,842 | A | * | 10/2000 | Rios | 211/133.4 |
| 6,216,887 | B1 | | 4/2001 | Soo | |
| 6,386,491 | B1 | * | 5/2002 | Bissett | 248/121 |
| 6,505,749 | B1 | * | 1/2003 | Panetta et al. | 211/86.01 |
| 6,626,406 | B1 | * | 9/2003 | Olson, Jr. | 248/219.3 |
| D487,831 | S | | 3/2004 | Savoie | |
| 6,726,033 | B2 | * | 4/2004 | Sparkowski et al. | 211/85.3 |
| 6,880,711 | B2 | | 4/2005 | Collier | |
| 6,925,754 | B1 | * | 8/2005 | Tearoe | 47/47 |
| 7,025,215 | B2 | | 4/2006 | Bain et al. | |
| 7,083,055 | B1 | | 8/2006 | Ambrosat | |
| D585,326 | S | * | 1/2009 | Donaldson | D11/130 |
| D599,601 | S | * | 9/2009 | Mallen | D6/552 |
| 2002/0005390 | A1 | | 1/2002 | DeRocher et al. | |
| 2005/0199567 | A1 | * | 9/2005 | Tardiff | 211/105.3 |
| 2006/0054576 | A1 | | 3/2006 | Durham | |
| 2006/0186073 | A1 | * | 8/2006 | Roe et al. | 211/196 |
| 2006/0186074 | A1 | * | 8/2006 | Bair | 211/205 |
| 2007/0175848 | A1 | * | 8/2007 | Mallen | 211/196 |
| 2008/0078731 | A1 | * | 4/2008 | Shibel | 211/85.7 |

OTHER PUBLICATIONS

Example drying rack 2, http://www.skate-buys.com/, unknown manufacturer, unknown manufacture date. Photo attached. Publication date at least as early as Oct. 28, 2006.

Example drying rack 3, http://www.hockey1.com/, unknown manufacturer, unknown manufacture date. Photo attached. Publication date at least as early as Mar. 22, 2006.

Example drying rack 4, http://www.americanhockeycenter.net/, unknown manufacturer, unknown manufacture date. Photo attached. Publication date at least as early as Dec. 12, 2006.

* cited by examiner

APPARATUS FOR ORGANIZING AND STORING SPORTS EQUIPMENT

TECHNICAL FIELD

The present invention is directed to a rack for drying, storing and organizing sports equipment. More specifically, the present invention is directed to a rack that can be customized to be used with different sizes and types of sports equipment and to accommodate different size storage areas.

BACKGROUND OF THE INVENTION

Sporting equipment, particularly in sports where padding is worn on the body such as hockey or football, tends to become wet or damp with the sweat of the players wearing the equipment. In time, such sporting equipment will have a tendency to smell bad, and if left in a sports bag for too long while it is wet or damp, it may be ruined by mold or mildew. Accordingly, such sporting equipment, particularly the various pads for the shoulders, knees, elbows etc., must be laid out to dry between uses. In addition to creating a mess in the player's home, as smelly, damp sporting equipment is set out to dry in whatever space is available, there is a substantial risk that individual pads can be separated from the rest of the equipment and misplaced. Racks that are known in the art for drying and organizing such sporting equipment are rather limited and of a fixed size. These prior art racks cannot be expanded or modified to make the best use out of the available storage space and, moreover, cannot be customized to accommodate the different sizes of the equipment used as young players get older and larger or change from one sport to another.

As such, a need exists for a product that provides a place to conveniently dry and organize sporting equipment, yet can be customized to accommodate the available area for storage as well as sports equipment of different sizes and types. As such, one or more embodiments of present invention are hereby presented.

SUMMARY OF THE INVENTION

This invention contemplates an improved apparatus for organizing and storing sports equipment that includes a central post having a vertical axis. The apparatus also includes a plurality of holes orientated substantially perpendicular to the vertical axis. A plurality of "tier" members are sized to be inserted into any one of the plurality of holes. The tier members have a first member and a second member. The second member is adapted to be slideably inserted into a first end of the first member. The second members are adapted to be secured at a plurality of positions within the first member, to permit the length of the plurality of substantially horizontal tier members to be changed.

In some embodiments, one or more holes extend through the vertical post and one or more first members are inserted through the holes in the vertical post. In such an embodiment, the tier members may additionally include a third member slideably inserted into a second end of the first member. The third member may also be adapted to be secured at a plurality of positions within the first member to change the overall length of the one or more tier members.

In addition or in the alternative, the apparatus may additionally include one or more structures attached to the central post, directly or indirectly, to form a base. These structures may include one or more horizontal leg portions attached to and extending away from the central post. At least a portion of the horizontal leg portions are essentially perpendicular to the vertical axis. In addition or in the alternative, these structures may include one or more diagonal leg portions attached to and extending from the central post. At least a portion of the diagonal leg portions extend from the central post at an angle from a perpendicular direction relative to the vertical axis.

In some embodiments, the apparatus may include wheels or castors secured to the base. Some embodiments may also include one or more hooks and/or clips such as "S" shaped hooks, spring-loaded clips, or variants thereof, to secure sports equipment to the "tier" members.

DETAILED DESCRIPTION OF THE INVENTION

Figure 1:
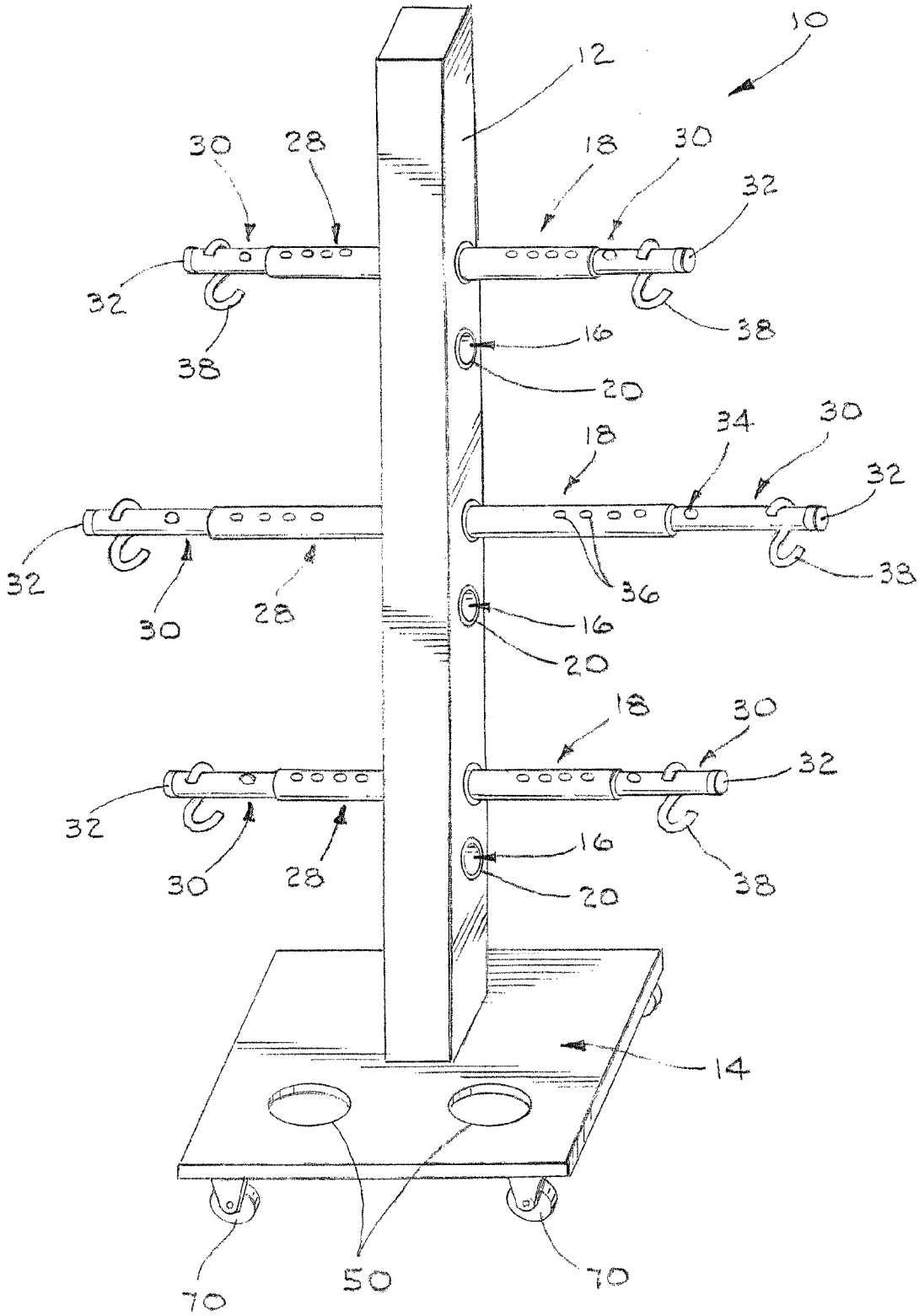
FIG. 1 is a front view of a rack assembly in accordance with one embodiment of the present invention.
Figure 2:
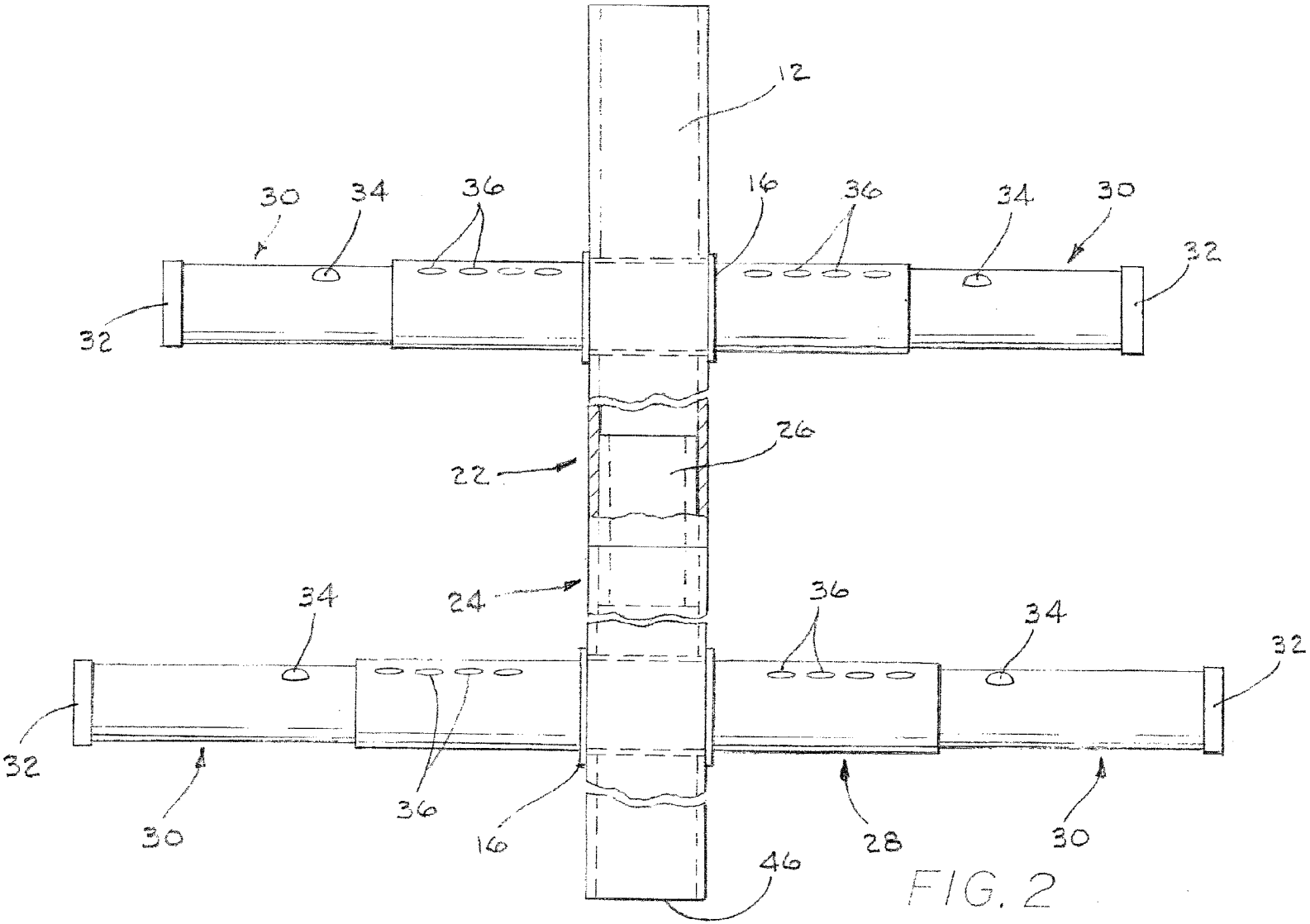
FIG. 2 is a front view of a central support post and tier members in accordance with one embodiment of the present invention.
Figure 3:
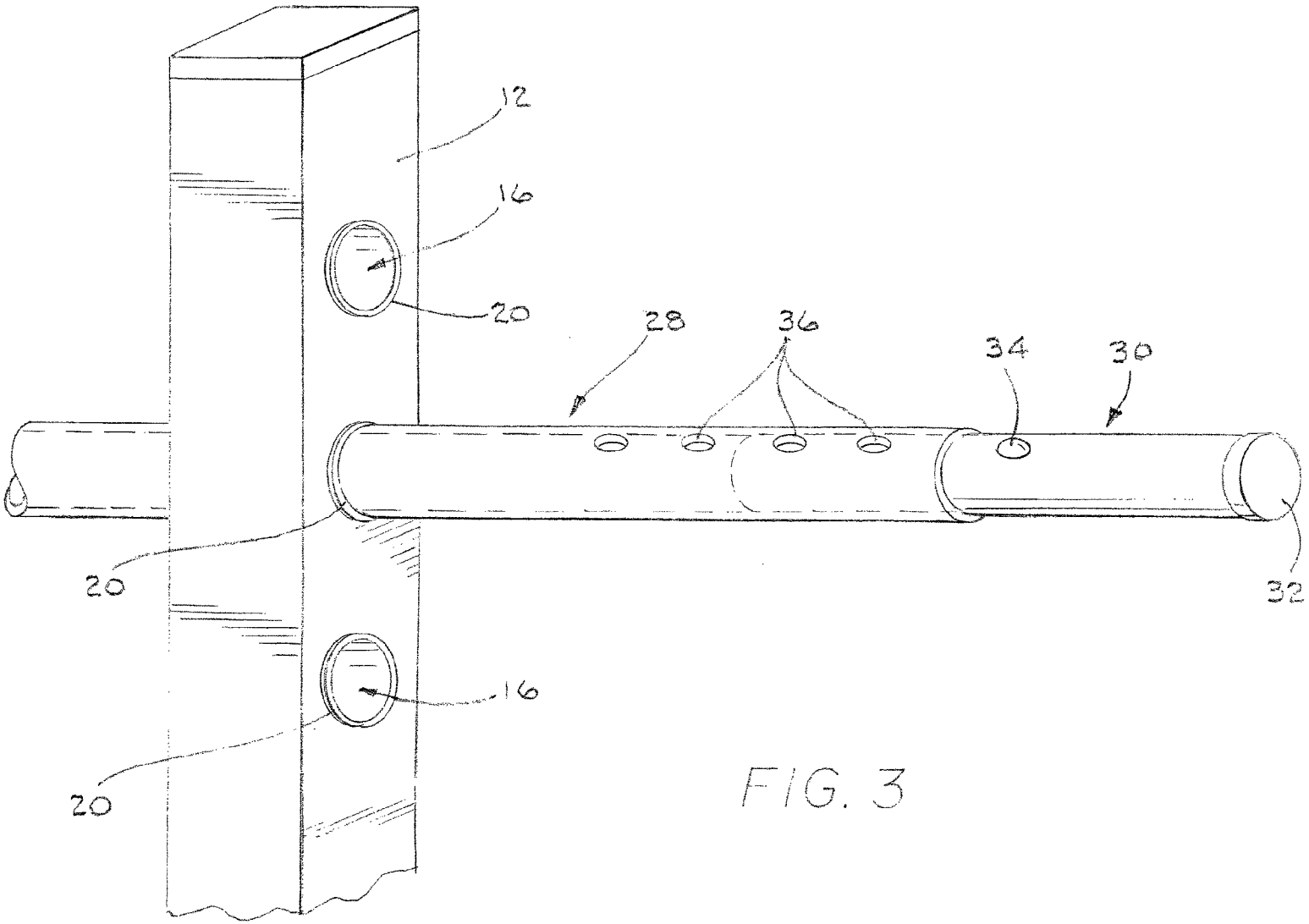
FIG. 3 is a front view of a central support post and tier members in accordance with one embodiment of the present invention.

Now referring to the drawings, a first embodiment of a rack for storing and organizing sports equipment, generally identified by reference numeral 10, is illustrated in FIGS. 1 and 2. Rack assembly 10 includes a central support post 12, a base 14, and one or more "tier" members 18.

The central support post 12 is secured at one end to the base 14 and extends vertically, from the base 14. The central support post 12 may be of any of a plurality of sizes and shapes and in one embodiment is sized to fit in a conventional closet. The central support post 12 has a plurality of "tier" arm height adjustment apertures 16 shown extending through the central support post and sized to receive one tier member 18. The tier members are generally shown herein in a horizontal position; however, the invention is not intended to be limited to such a configuration. Each of these tier arm height adjustment apertures 16 may have mounted within one or more gaskets 20 that secure the tier member 18 and keep it from slipping out of the center support base. The gasket 20 may optimally be flexible enough to allow the tier member 18 pass through the tier arm height adjustment apertures 16 and should press against the tier member 18 holding it in place. Suitable materials for gasket 20 include, but are not limited to, rubber, polyurethane, or any other known material which may be suitable.

The number of tier arm height adjustment apertures 16 may exceed the number of tier members 18 to allow the tier members 18 to be moved from one height to another height, thus changing the distances between the base 14 and the tier members 18, as well as the distances between different tier members 18. In this way the rack assembly can be configured and reconfigured by the user to accommodate different size equipment and equipment used in different sports.

In the embodiment depicted in FIG. 1, the central support post 12 is square, but it could be other shapes such as round, rectangular, oval, hexagonal, or other geometric or even non-geometric shapes. Optimally, its diameter may be greater than the diameter of the tier members 18 and the support post is strong enough to support the plurality of tier members 18 and associated sports equipment. The central support post 12 can be made from any suitable material including metals, plastics, fiberglass, or wood and can be solid or, if weight of the rack is a concern, it can be hollow. Accordingly, the apertures 16 can be holes through the walls on opposite sides of a hollow support post 12, a continuous hole through a solid support post 12, or blind holes that support only one end of a tier member 18. In the last instance, the tier members 18 are adapted to be secured in support post 12, such as by engagement of threads (not shown) on one end of tier member 18 into a threaded aperture 16, or by any other appropriate methods. In addition, the central support post 12 can be constructed in one section or in multiple sections for ease in shipping and packaging.

A central support post 12 made up of two sections is illustrated in FIG. 2. As shown in FIG. 2, the upper section 22 and lower section 24 can be connected by means of a connection piece 26, friction fit to the interior of the two sections and extending between them. The connection piece 26 can be made from any commercially available material, including rubber, plastic, wood, fiberglass or metal and can, if desired, be secured in place with one or more screws or other fastening means. Alternatively, the end of one section may be sized to be inserted and friction fit within the end of the other section. In still another example, a spring-biased button (not shown) may be used to secure an upper section to a lower section, in a similar way as that described below with regard to the use of a spring-biased button in the tier members. Such a use of a spring-biased button may also permit the height of the central support post, and therefore, the height of the rack itself, to be adjustable.

In the embodiment shown, each tier member 18 has a first or center section 28 and two end sections 30 that are sized to fit within the center section 28 such that the two end sections 30 can be telescopically extended to increase the length of the tier members 18. There may be plastic or rubber end caps 32 on the exposed end of the end segments 30. The end segments 30 may be secured at a desired length by any one of many methods known in the art. In the embodiment depicted in FIGS. 1-4, each end section 30 is secured within the center section 28 at a series of set lengths by means of a spring biased button 34 in end section 30 that can be depressed into the end segment 30 to create a flat surface permitting the end section 30 to slide into the center section 28. The center section 28 has a series of holes 36 that are slightly larger than the button 34 and which correspond to predetermined lengths. When the button 34 is positioned below one of these holes 36, a spring biases the button up through both the end segment 30 and center segment 28, securing the two together at that preset length. In alternative embodiments, the end segments may be secured by a threaded ring or ring and clamp that apply pressure to the end of the center segment forcing it into contact with the end segments, by a threaded end piece on the end section 30 that spreads out contacting the inner surface of the center section 28 when the end section 30 is turned, or any one of several other methods well known to those in the art.

Figure 4:
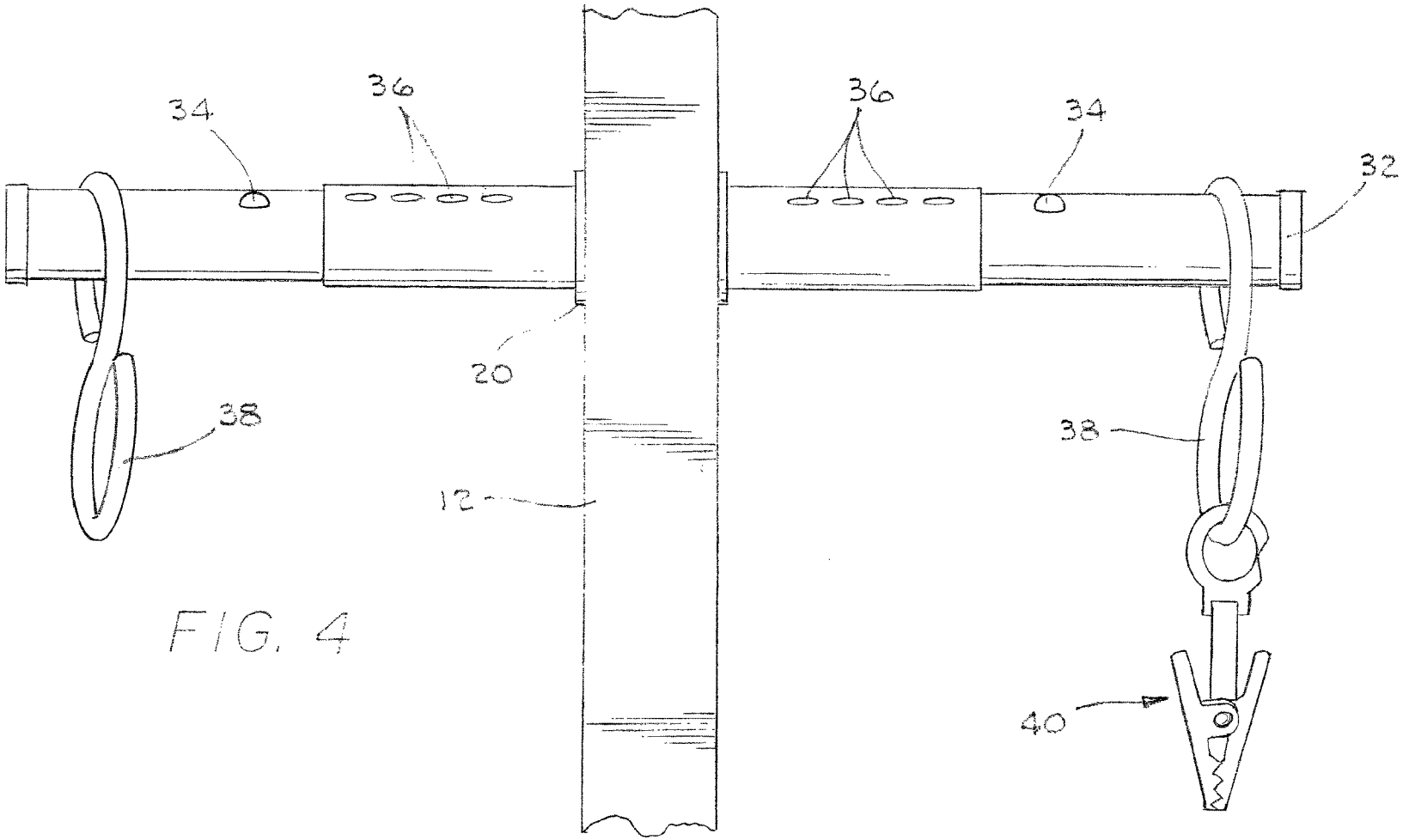
FIG. 4 is a front view of an adjustable tier member, "S" shaped hooks and clips in accordance with one embodiment of the present invention.

As illustrated in FIGS. 2 and 4, the sports equipment may also be secured to the tier members 18 by means of one or more "S" shaped hooks 38 or by clips 40 secured to the tier members 18. Alternative arrangements are also possible, such as a clip 40, attached to tier member 18 by way of an "S" hook 38.

Figure 5:
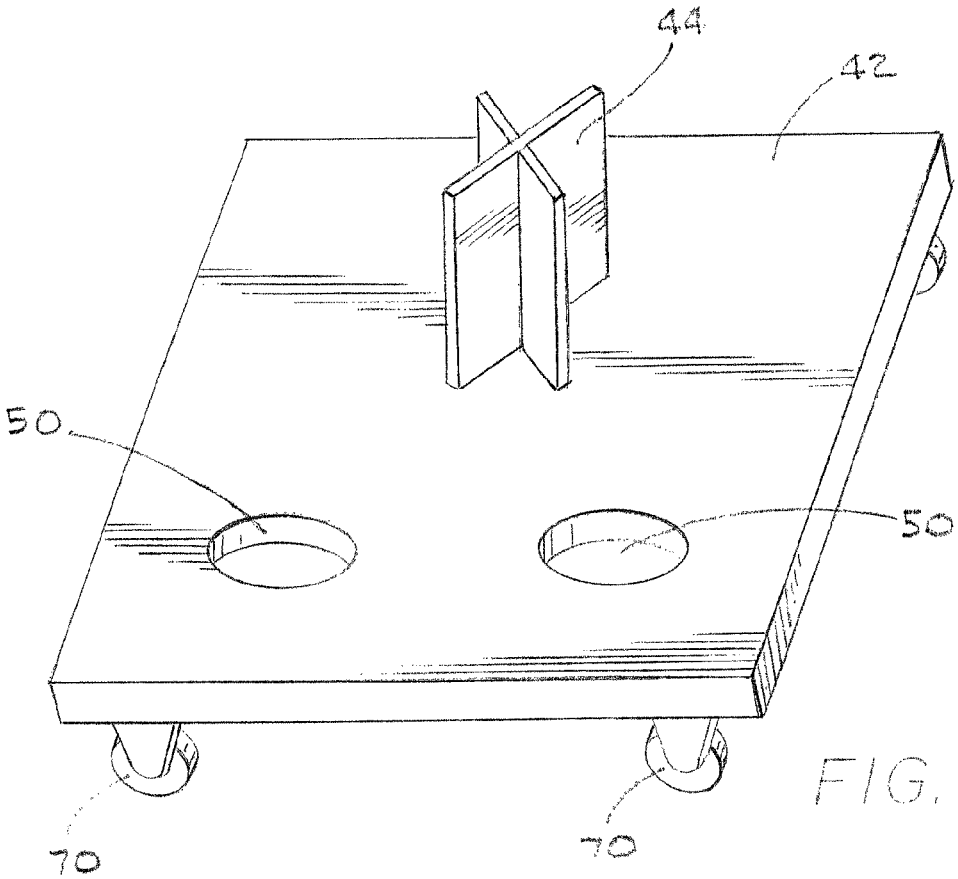
FIG. 5 is a front view of a square base in accordance with one embodiment of the present invention.
Figure 6:
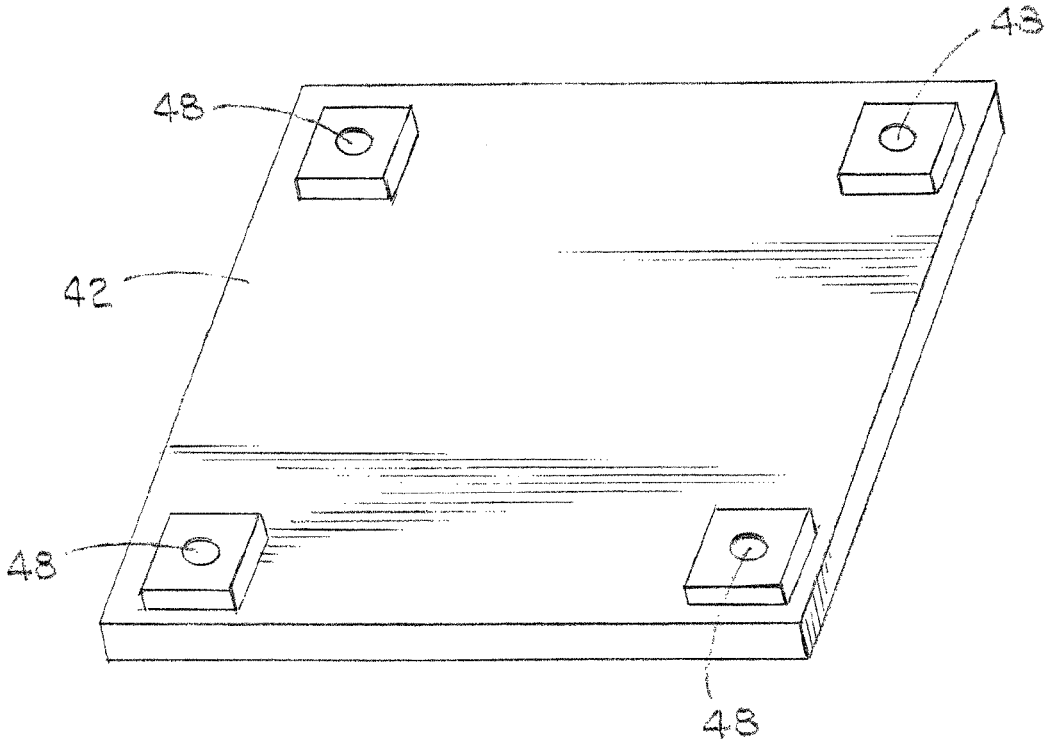
FIG. 6 is a bottom view of a square base in accordance with one embodiment of the present invention.

Various types of bases 14 that may be used with the rack assembly 10 are illustrated in FIGS. 5-9 and are well in known in the art. FIGS. 1, 5 and 6 depict a square base 42. The square base 42 illustrated in FIGS. 1, 5, and 6 is essentially horizontal or perpendicular to the vertical axis of support post 12, and can be made from any suitable material including metals, plastics, fiberglass, or wood. Optimally, the weight and/or dimensions of the base should be chosen to keep the rack 10 from falling over. It may be secured to the central support post 12 by any known method such as threads, screws or welding. In the embodiment illustrated in FIGS. 1 and 5, the central support post 12 is secured to the square base 42 by means of a receiving post 44 sized to fit securely into an opening 46 at the bottom of the central support post 12. Receiving post 44 may be solid, hollow, "X" shaped, or any other shape that fits within the central support post 12, securing the central support post 12 to the base 14.

In the embodiment illustrated in FIG. 6, the bottom surface of the square base 42 has a series of castor openings 48 at each corner sized to receive the post of a castor or wheel. Depending upon the material used to construct the square base 42, each castor opening 48 may be reinforced to provide added strength to the area of the square base 42 surrounding the castor openings 48. In addition, the rack assembly 10 may have round depressions or openings 50 in the square base 42 sized to receive sports bottles (not shown).

Figure 7A:
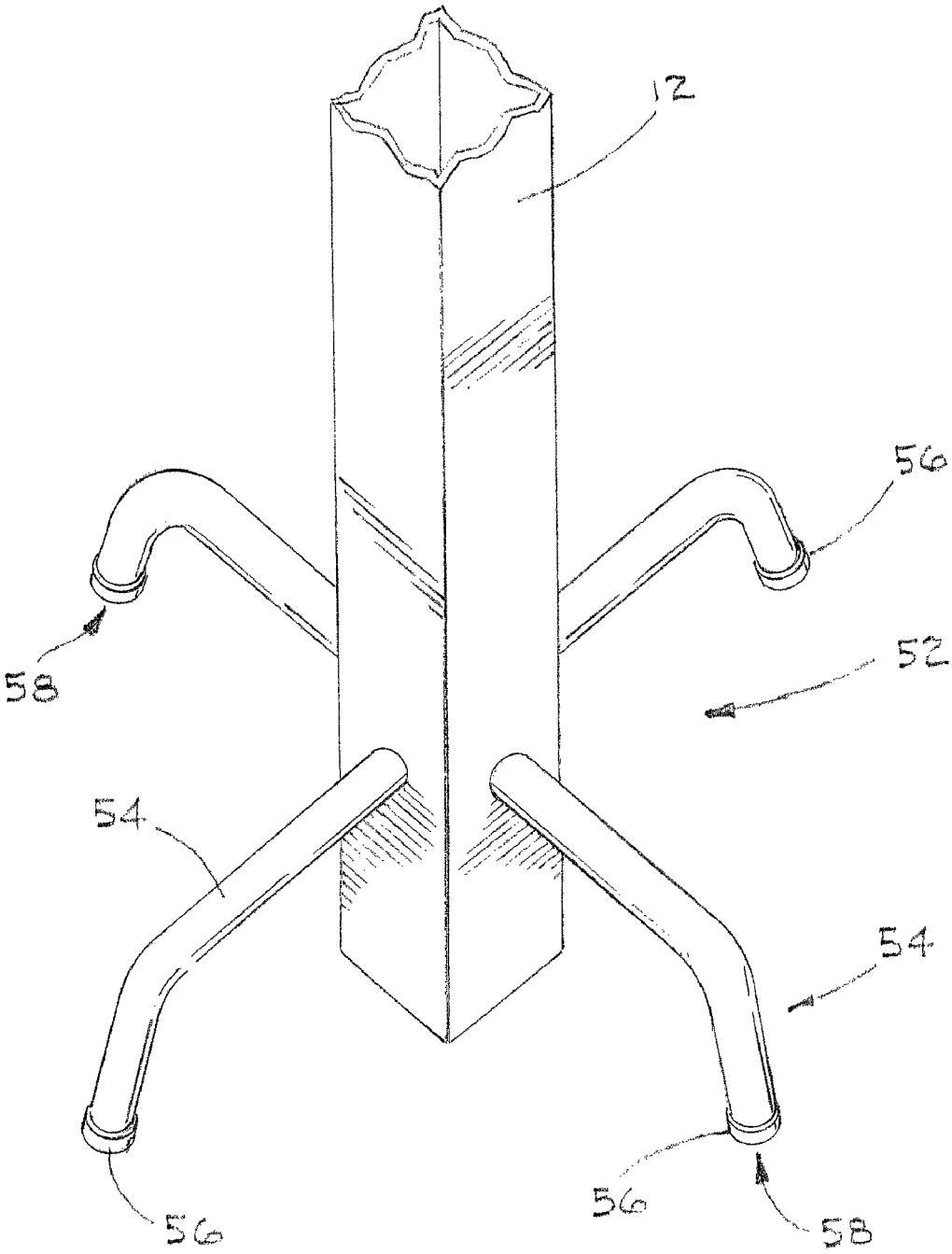
FIG. 7A is a front view of an arched leg base in accordance with another embodiment of the present invention.

An alternative arched leg base 52 is depicted in FIG. 7A and is well known in the art. The arched leg base 52 illustrated in FIG. 7A has four legs 54 running from the central support post 12 to the ground and providing support for the central support post 12. The arched leg base 52 may have 3 or more legs 54 depending upon the shape of the central support post and the number of legs 54 desired. The legs 54 may be secured to the central support post 12 by a variety of methods known in the art such as welding, threads on the legs and/or openings in central support post 12 for receiving the legs, or friction fit into the openings with or without a rubber or plastic gasket. The legs 54 may have plastic or rubber end caps 56 to prevent damage to floors or, alternatively, these caps 56 may have a castor opening 58 to receive the post of a castor or wheel.

Figure 7B:
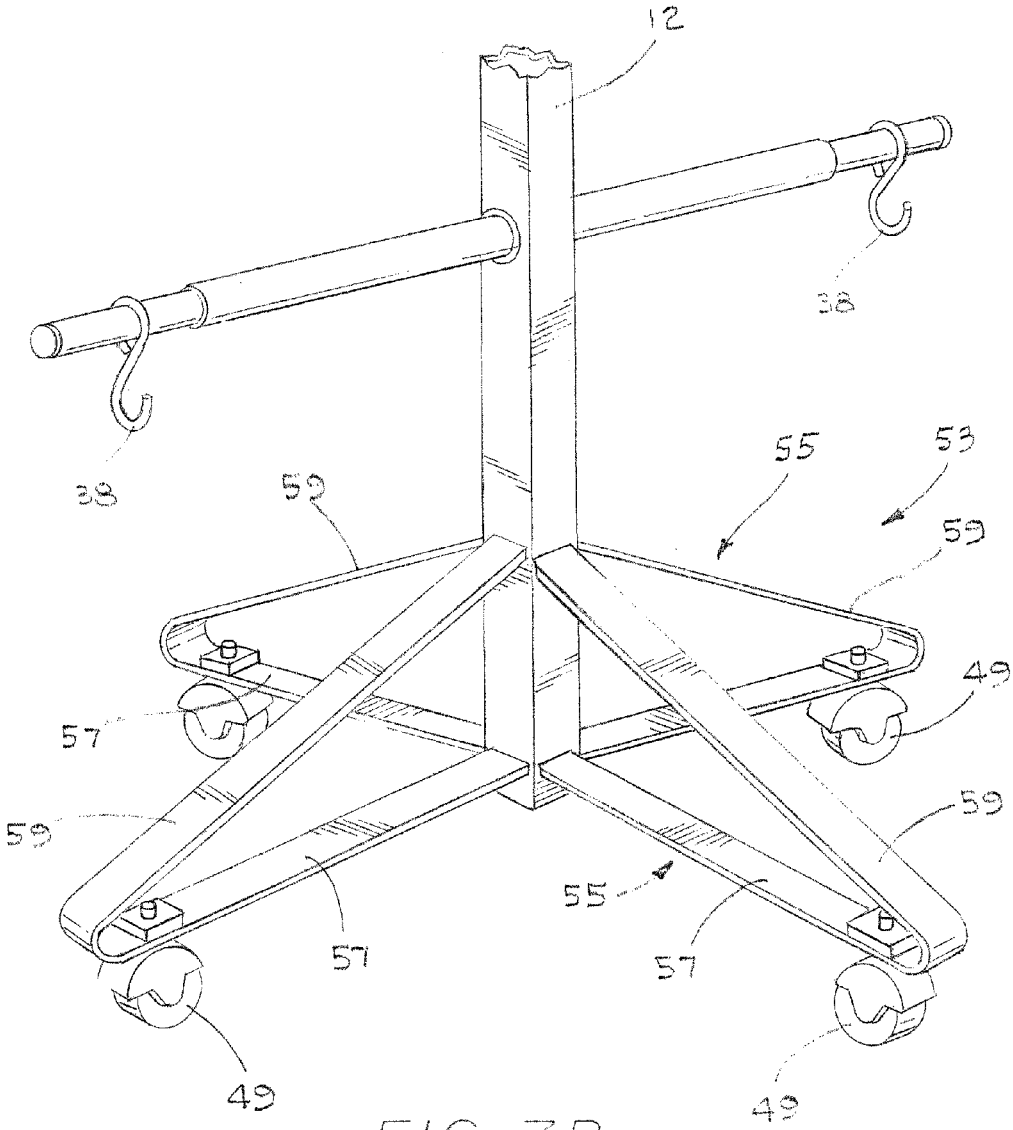
FIG. 7B is a front view of a base having both horizontal leg portions and diagonal leg portions in accordance with another embodiment of the present invention.

A variant of an arched leg base may be seen in FIG. 7B. In FIG. 7B, the leg base 53 has four sets of leg assemblies 55. Each leg assembly 55 has a horizontal leg portion 57 which is attached to support post 12 on a first end and extends outward from support post 12. In the particular embodiment shown, horizontal leg portion 57 extends from support post 12 essentially horizontally, and may have castor openings at or near a second end for receiving a post of a wheel assembly or castor. The leg assemblies 55 also include a diagonal leg portion 59, which is longer than horizontal leg portion 57. A first end of diagonal leg portion 59 is attached to support post 12, spaced from the first end of horizontal leg portion 57. Diagonal leg portion 59 extends outward from support post 12 at an angle from a horizontal orientation. A second end of diagonal leg portion 59 contacts the second end of horizontal leg portion 57. Horizontal leg portion 57 and diagonal leg portion 59 may be separate components or, as shown in FIG. 7B, they may be different ends of a single component shaped to form the two leg portions 57, 59.

Figure 8:
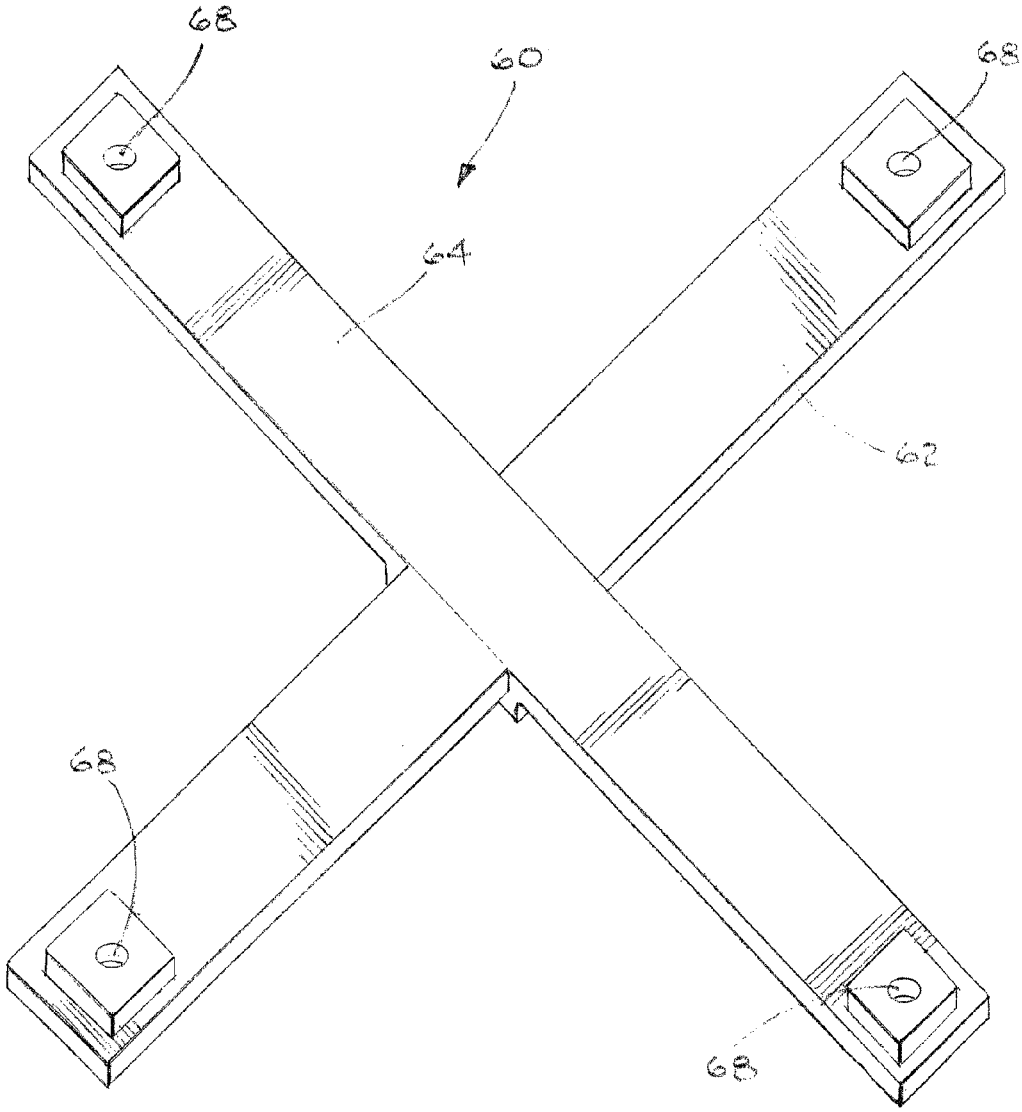
FIG. 8 is a bottom view of an "x" shaped base in accordance with another embodiment of the present invention.
Figure 9A:
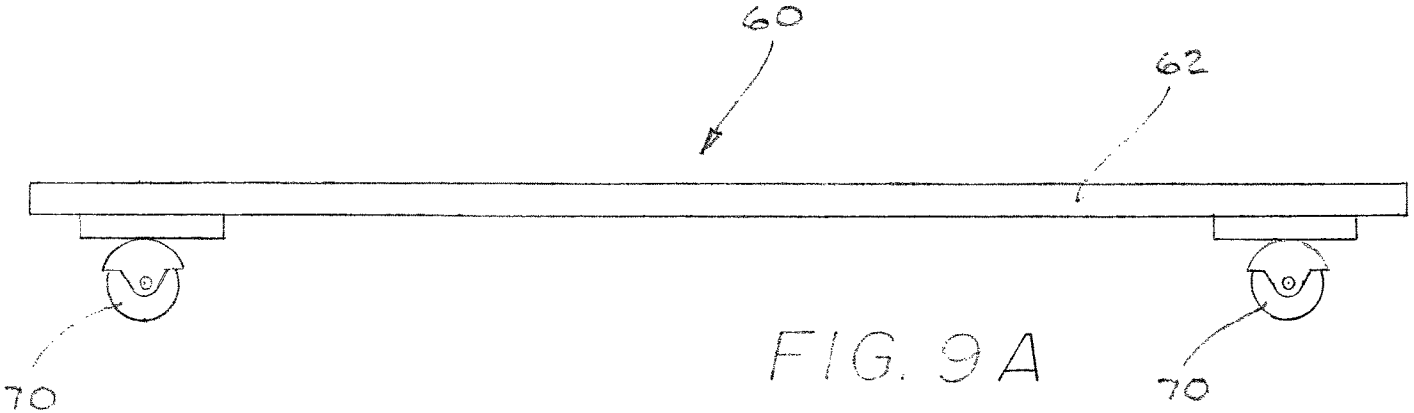
FIGS. 9A and 9B are side views of an "x" shaped base in accordance with an embodiment of the present invention.
Figure 9B:
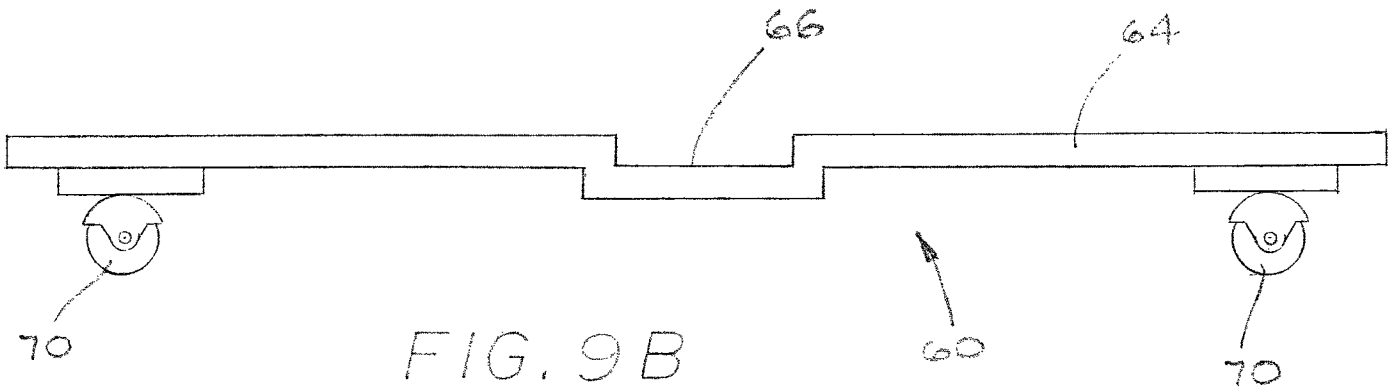

An alternative "X"-shaped base 60 is illustrated in FIGS. 8-9. The "X"-shaped base 60 has an upper member 62 and lower member 64. In the "X"-shaped base 60 illustrated in FIGS. 8 and 9, the lower member 64 has recess 66 for receiving the upper member 62, but other known methods could also be used. At both ends of the upper member 62 and the lower member 64 of the "X"-shaped base 60 there may be castor openings 68 to receive the post of a castor or wheel. Depending upon the material used to construct the "X"-shaped base 60, each castor opening 68 may be reinforced to provide added strength to the area of the "X"-shaped base 60 surrounding the castor openings 68.

The bases that may be used with rack assembly 10 are in no way limited to the specific embodiments illustrated in FIGS. 4-9 and described herein, but can be of any design known in the art for this purpose so long as the base has sufficient weight and breadth to keep the rack assembly 10 from falling over and can be secured to the central support post 12.

Figure 10A:
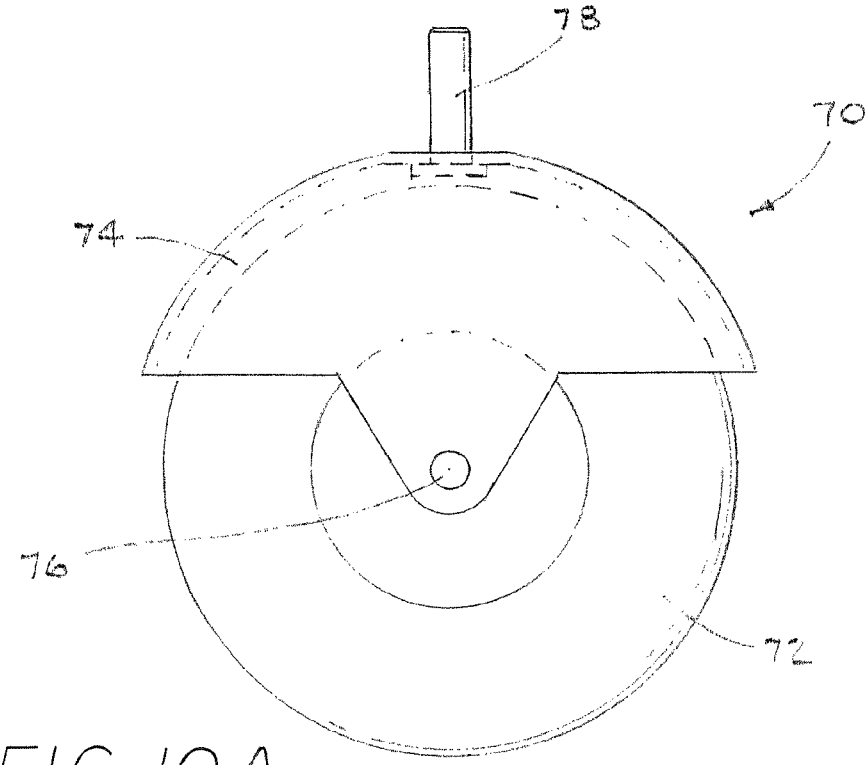
FIGS. 10A and 10B are side and front views, respectively, of wheel assemblies in accordance with an embodiment of the present invention.
Figure 10B:
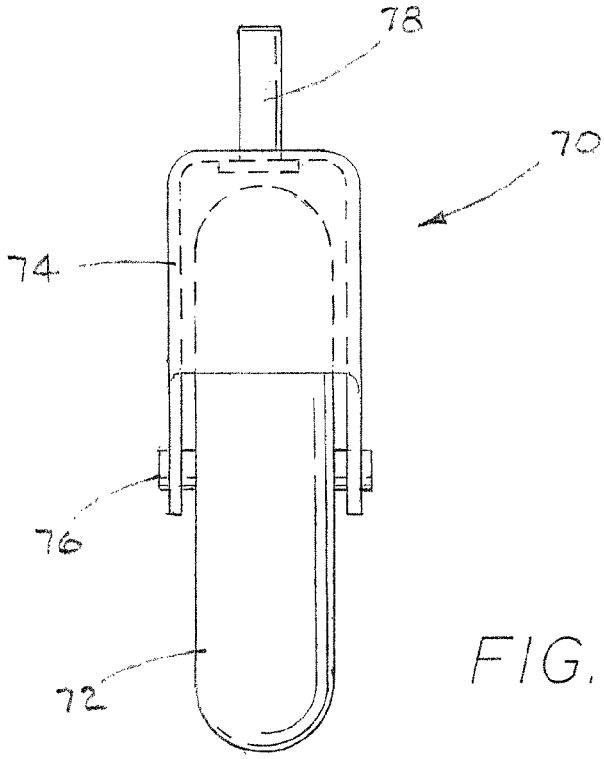

The rack assembly 10 may be placed on wheels to facilitate movement of the rack assembly into and out of a closet or for transport. FIG. 10 illustrates a wheel assembly 70 that may be used. The wheel assembly 70 depicted in FIG. 10 has a wheel 72 under a "U"-shaped bracket 74. The wheel 72 is secured within the "U"-shaped bracket 74 by an axle 76 and is free to rotate around the axle. The "U"-shaped bracket 74 is secured to the base 14, 42, 52, 60 by means of a post 78 and the "U"-shaped bracket 74 is free to rotate a full 360 degrees around the post 78. Other suitable wheel and/or castor designs well known in the art for this purpose may also be used.

The principles, preferred embodiments and modes of operation of the present invention have been described in the forgoing application. The embodiments of the invention that are intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in the appended claims.

What is claimed is:

1. An apparatus for organizing and storing sports equipment comprising:

a central post, having a vertical axis;

a plurality of holes located in the central post, orientated substantially perpendicular to the vertical axis;

a plurality of tier members sized to be inserted into any one of the plurality of holes in the central post, said tier members having a first member and a second member, the second member having a first end slideably inserted into a first end of the first member and having a second free distal end, and further securing the second member at any one of a plurality of first predetermined locking positions within the first member wherein each first predetermined locking position provides a disparate length of the tier member, and wherein the second member is movable between the plurality of first predetermined locking positions.

2. The apparatus of claim 1, wherein one or more of said plurality of holes located in the central post extend through the central post and wherein at least one of said one or more first members is inserted through the one or more holes in the central post and at least one of said one or more tier members additionally comprises a third member having a first end slideably inserted into a second end of the first member and having a second free distal end, the third member being secured at any one of a plurality of second predetermined locking positions within the first member wherein each second predetermined locking position provides a disparate length of the tier member, and wherein the third member is movable between the plurality of second predetermined locking positions.

3. The apparatus of claim 2, additional comprising a plurality of substantially "S"-shaped hooks secured to at least one of said plurality of tier members.

4. The apparatus of claim 2, additionally comprising a plurality of spring biased clips secured to at least one of said plurality of tier members.

5. The apparatus of claim 2, wherein said first and second predetermined locking positions of said first member comprise a plurality of apertures in said first member, and wherein said second member is secured at any one of said plurality of first predetermined locking positions within the first member by engaging any of the one or more apertures of the first member to secure said second member at any of said plurality of first predetermined locking positions, and wherein said third member is secured at any one of a plurality of said plurality of second predetermined locking positions within the first member by engaging any of said plurality of apertures of the first member to secure said third member at any of said plurality of second predetermined locking positions.

6. The apparatus of claim 2, additionally comprising one or more structures attached to the central post to form a base.

7. The apparatus of claim 6, additionally comprising a plurality of spring biased clips secured to at least one of said plurality of tier members.

8. The apparatus of claim 6, wherein the base includes one or more horizontal leg portions attached to and extending away from the central post and wherein at least a portion of the one or more horizontal leg portions is essentially perpendicular to the vertical axis.

9. The apparatus of claim 8, further including a plurality of wheel members or castor members secured to the base.

10. The apparatus of claim 8, additionally comprising a plurality of substantially "S"-shaped hooks secured to at least one of said plurality of tier members.

11. The apparatus of claim 8, additionally comprising a plurality of spring biased clips secured to at least one of said plurality of tier members.

12. The apparatus of claim 8, additionally comprising a plurality of diagonal leg portions having first and second ends, attached on the first end to the central post at a distance spaced from the horizontal leg portions.

13. The apparatus of claim 12, additionally comprising a plurality of spring biased clips secured to at least one of said plurality of tier members.

14. The apparatus of claim 12, wherein at least one of said one or more horizontal leg portions and at least one of said plurality of diagonal leg portions are portions of a single component shaped to form the horizontal leg portion and the diagonal leg portion.

15. The apparatus of claim 14, further including a plurality of wheel members or castor members secured to the base.

16. The apparatus of claim 14, additionally comprising a plurality of spring biased clips secured to at least one of said plurality of tier members.

17. The apparatus of claim 14, wherein said first predetermined locking positions of said first member comprise a plurality of apertures in said first member, and wherein said second member is secured any one of said plurality of first predetermined locking positions within the first member by engaging any of the one or more apertures of the first member to secure said second member at any of said plurality of first predetermined locking positions.

18. The apparatus of claim 1, additionally comprising a plurality of substantially "S"-shaped hooks secured to at least one of said plurality of tier members.

19. The apparatus of claim 1, additionally comprising a plurality of spring biased clips secured to at least one of said plurality of tier members.

20. The apparatus of claim 1, wherein said first predetermined locking positions of said first member comprise a plurality of apertures in said first member and wherein said second member is secured at any one of said plurality of first predetermined locking positions within the first member by engaging any of the one or more apertures of the first member to secure said second member at any of said plurality of first predetermined locking positions.

* * * * *